United States Patent [10]

Chapman

[11] 4,052,829

[45] Oct. 11, 1977

[54] SEMI-PREFABRICATED MONOLITHIC STEEL-REINFORCED CEMENT BUILDING CONSTRUCTION

[76] Inventor: Ward W. Chapman, 2700 W. 3rd Court, Hialeah, Fla. 33010

[21] Appl. No.: 667,653

[22] Filed: Mar. 17, 1976

[51] Int. Cl.[2] ..... E04B 1/00; E04B 5/00

[52] U.S. Cl. ..... 52/285; 52/234; 52/274; 52/343; 52/454; 52/457

[58] Field of Search ..... 52/234, 274, 285, 601, 52/449, 676, 454, 662, 343

[56] References Cited

U.S. PATENT DOCUMENTS

| | | | |
|---|---|---|---|
| 1,049,629 | 1/1913 | White | 52/662 |
| 1,514,561 | 11/1924 | Morreale | 52/343 |
| 2,131,465 | 9/1938 | Levy | 52/285 |
| 2,223,016 | 11/1940 | Parkhurst | 52/234 |
| 2,391,960 | 1/1946 | Gede, Jr. | 52/234 |
| 2,476,135 | 7/1949 | Colburn | 52/274 |
| 3,373,536 | 3/1968 | Reimbert | 52/234 |

*Primary Examiner*—Ernest R. Purser
*Assistant Examiner*—Robert C. Farber
*Attorney, Agent, or Firm*—Ernest H. Schmidt

[57] ABSTRACT

A method and means by which buildings, particularly residential buildings, can be prefabricated of cut-to-size metal wall framing and roof member elements for erection upon a prepared foundation at the site, the building framework thus erected being adapted to structural completion by a process involving scratch cement-plaster coating the outsides of expanded sheet metal enclosing the rib-work of the walls and the underside of roofing rib framework assembly, and thereafter pump-spraying a cementacious mixture between the voids of such rib-work against the opposite side of the scratch-coated expanded sheet metal to provide a substantially monolithic steel-reinforced basic building structure.

10 Claims, 14 Drawing Figures

SEMI-PREFABRICATED MONOLITHIC STEEL-REINFORCED CEMENT BUILDING CONSTRUCTION

This invention relates to building construction and is directed particularly to improvements in prior methods and means of prefabricated or semi-prefabricated building construction whereby economies in the use of labor, skills and materials is reduced to a minimum heretofore unattainable in comparable building construction. The principal object of this invention is to provide a method and means of building construction which is particularly well-suited to prefabrication of the building framework or skeletal structure, including roofing framework, at the factory for erection upon a suitable foundation prepared at a remote site, such framing, upon erection being of such construction as to provide for completion of the building for the most part simply by hand application, and or, the pump spraying in place of cementacious materials.

A more particular object of the invention is to provide a partially prefabricated building construction of the above nature wherein the walls and skeletal roofing structure are comprised of spaced, parallel steel rib members faced on one side with expanded sheet metal which, upon erection of the steelwork at the building site, can readily be scratch-coated with cement plaster to provide an initial rigidity in the skeletal structure sufficient to allow pressure spraying in place of pumped cement or cementacious mixture at the opposite side of the scratch-coated surfaces between the metal ribs to complete the rough structural assembly of the building as a monolithic, rigid unit ready for surface finishing.

Still another object of the invention is to provide a partially prefabricated, unitary steel and cement building construction of the character described wherein, prior to spraying in place of the structural cementacious mixture, rough plumbing, electrical piping and the like can be installed within the ribwork of the walls to be completely embedded therein in the finished construction and wherein, because of the strength and impenetrability of such completed walls, electrical duct-work can be of a less rigid and less expensive material then heretofore required, such as of flexible plastic tubing, thereby further economizing in labor and materials involved in the completion of the building.

Yet another object of the invention is to provide a method and means of building construction of the above nature wherein smooth and level surface-finishing of hand applied and/or, the sprayed-in-place cementacious material can readily be accomplished by screeding against outer edge portions of the rib members of the metal skeletal structure, including the use of window frames, and door sub-frames and the like as additional screeding surfaces.

Still another object of the invention is to provide a semi-prefabricated building construction of the character described wherein the previously scratch-coated, expanded sheet metal can readily be finished by the trowel application of a cement plaster finish coat in the ordinary fashion, and wherein exterior and interior surface areas of the building can readily be ornamentally treated with imitation brickwork, stonework or the like, as desired, at minimal extra cost.

Another object of the invention is to provide a novel and improved roofing construction for semi-prefabricated monolithic buildings of the character described wherein the roof-framing ribs are comprised of spaced, parallel, double [-channel members, secured back-to-back, and providing spaced slots for the sliding reception of roofing insulation panels, thereby further simplifying and expediting erection of the building at the job site.

Yet another object of the invention is to provide building construction of the character hereinabove described wherein the cementacious roof deck can be either poured or pump-sprayed in place, without temporary shoring from below, against the underlying supporting structure of scratch-coated expanded sheet metal and insulation board, screeded to a surface finish at the top edge of [-ribs and weather-proofed by a trowelled-on application of roof sealant.

Another object of the invention is to provide residential housing of substantially monolithic, steel reinforced concrete, including a concrete floor slab and foundation footings, that will be strong enough to withstand even the more severe of earthquake tremors with minimal liklihood of severe damage, thereby offering superior protection for inhabitants in earthquake-prone areas.

Another object of the invention is to provide a building construction of the character described which will be virtually fire-proof and termite proof.

Another object of the invention is to provide a novel and improved method and means of building construction of the character above described which, because of its unique constructional methods, requires reinforcing steel in the foundation only, with wall and roof rib framing consistent with reinforcing strength requirements, a minimal number of simple steps during construction, a minimum of materials, and a minimum of labor, particularly skilled labor in completing the erection of the building, thereby lending itself particularly well to the fulfillment of needs of low cost residential housing in underdeveloped and impoverished areas of the world.

Yet another object is to provide a method and means of building construction resulting in a good basic building structure, whether residential or non-residential, at low comparative cost heretofore unattainable, and wherein construction at the job site of a small building can be completed, from start to finish, in approximately 8 to 10 days.

Other objects, features and advantages of the invention will be apparent from the following description when read with reference to the accompanying drawings. In the drawings, wherein like reference numerals denote corresponding parts throughout the several views.

Figure 2:
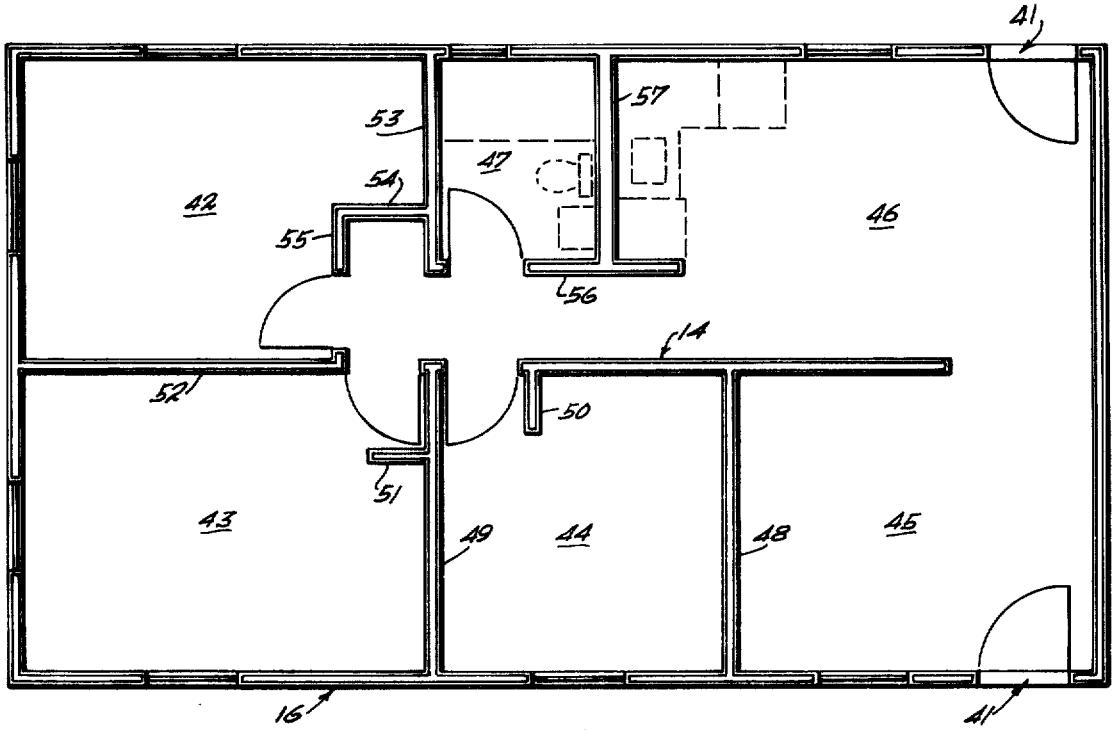
FIG. 2 is a floor plan of the building shown in FIG. 1.
Figure 6:
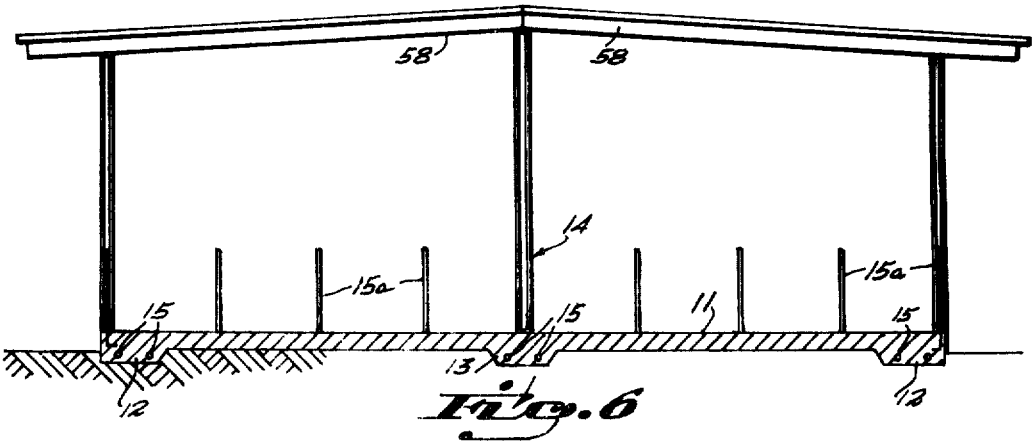
FIG. 6 is section through the building taken along the line 6—6 of FIG. 4.
Figure 7:
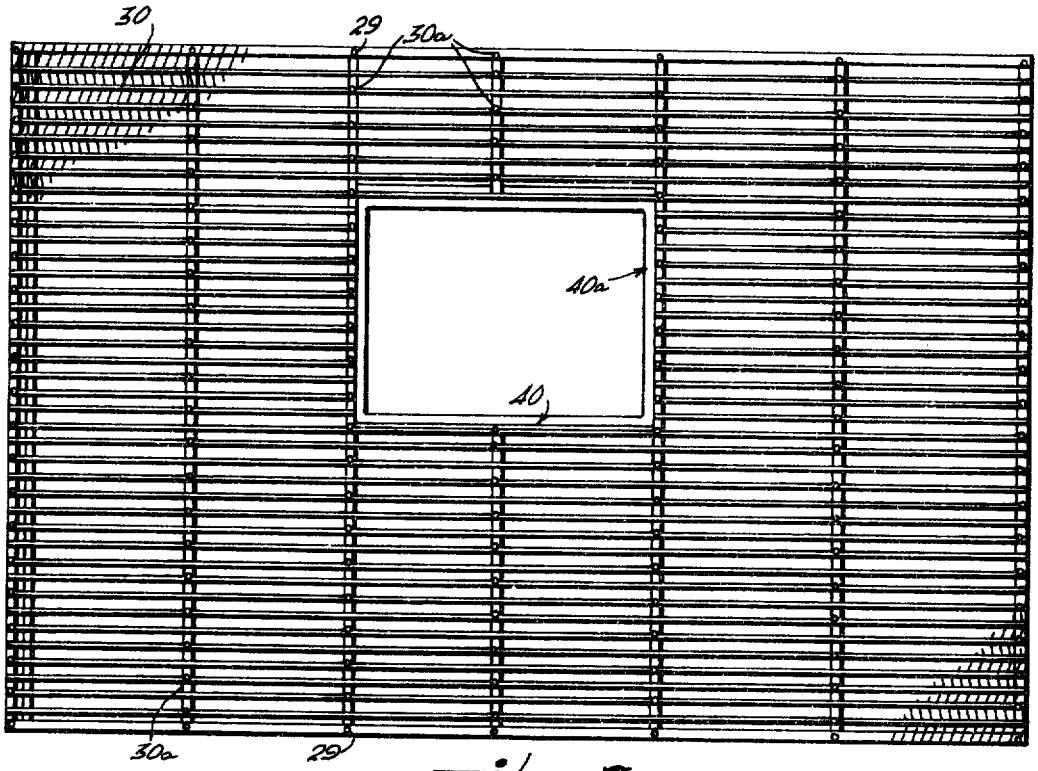
FIG. 7 is a separate view, on an enlarged scale, of one of the prefabricated steel sidewall panels, prior to erection and assembly upon the building slab.

Referring now to the drawings in detail, reference numeral 10 designates, generally and by way of example, a small residential house constructed of semi-prefabricated steel and monolithic cementacious material according to the invention; and FIG. 2 illustrates the floor plan thereof. The building is erected and finished, by the method and means as hereinafter more particularly described, on a prepared foundation, preferably a concrete slab 11. As best illustrated in FIG. 6, the slab 11 will be monolithically poured with a peripheral footing 12 including such interior footings 13 placed to additionally support interior bearing walls, such as wall 14 in FIG. 6. The slab footings 12, 13 will preferably be reinforced with steel rod 15, as may be required by local building codes, and will have embedded therein peripheral reinforcing steel rod anchors **15*a*** (shown in FIG. 6) spaced about four feet on centers, extending vertically upwardly to be embedded in the outer and bearing walls of the building as is hereinbelow more particularly described.

Figure 3:
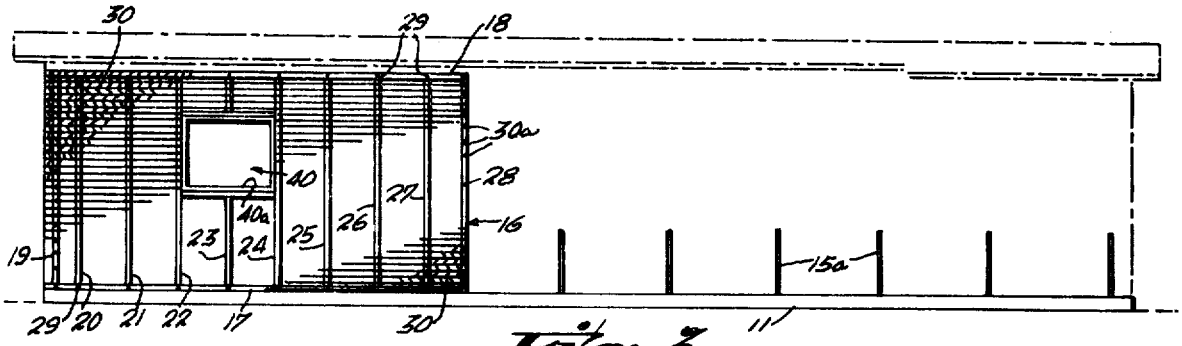
FIG. 3 is a front elevational view illustrating erection of the steel panels on the prepared concrete floor slab as a beginning step in fabrication of the front of the building.

Referring now to FIG. 3, reference numeral 16 designates, generally one of the outer wall metal framing panels being erected in place as a first step in completion of the building on the site. As hereinbelow described, each of the building wall panels typified by the wall 16 for example, comprises formed metal sole plate, rib and top plate members, and expanded sheet metal facing, which components will ordinarily be precut and packaged at the factory for compact shipment to the building site. It will be understood the wall panels may differ from one another depending upon the design of the building to be constructed; that is, some will be provided with window openings, some with door openings, and their size may vary in accordance with the size and floor plan of the building.

Figure 1:
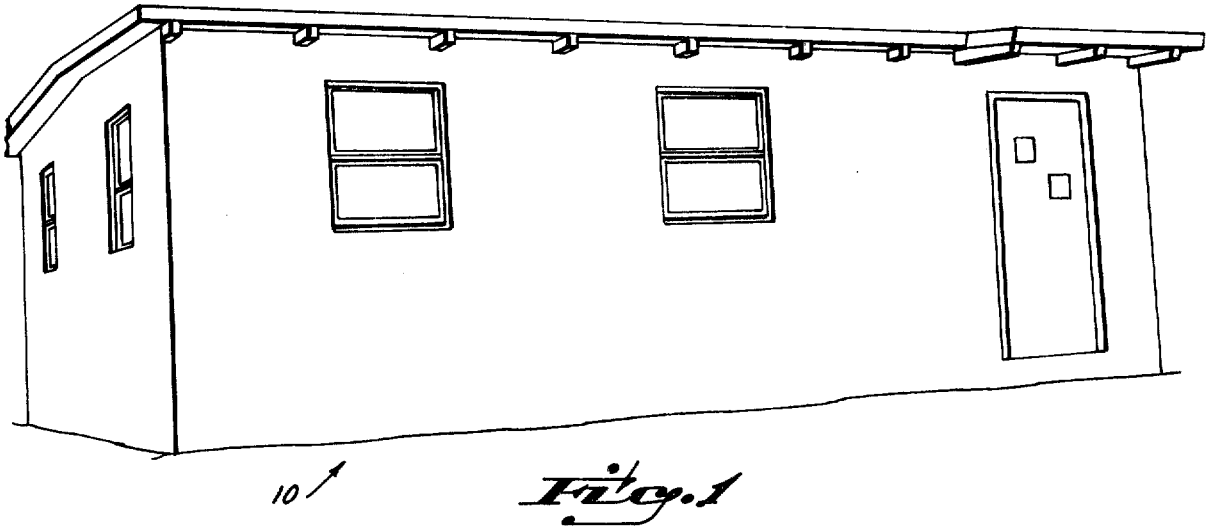
FIG. 1 is a perspective view of a typical residential building embodying the invention, as seen from the front.
Figure 9:
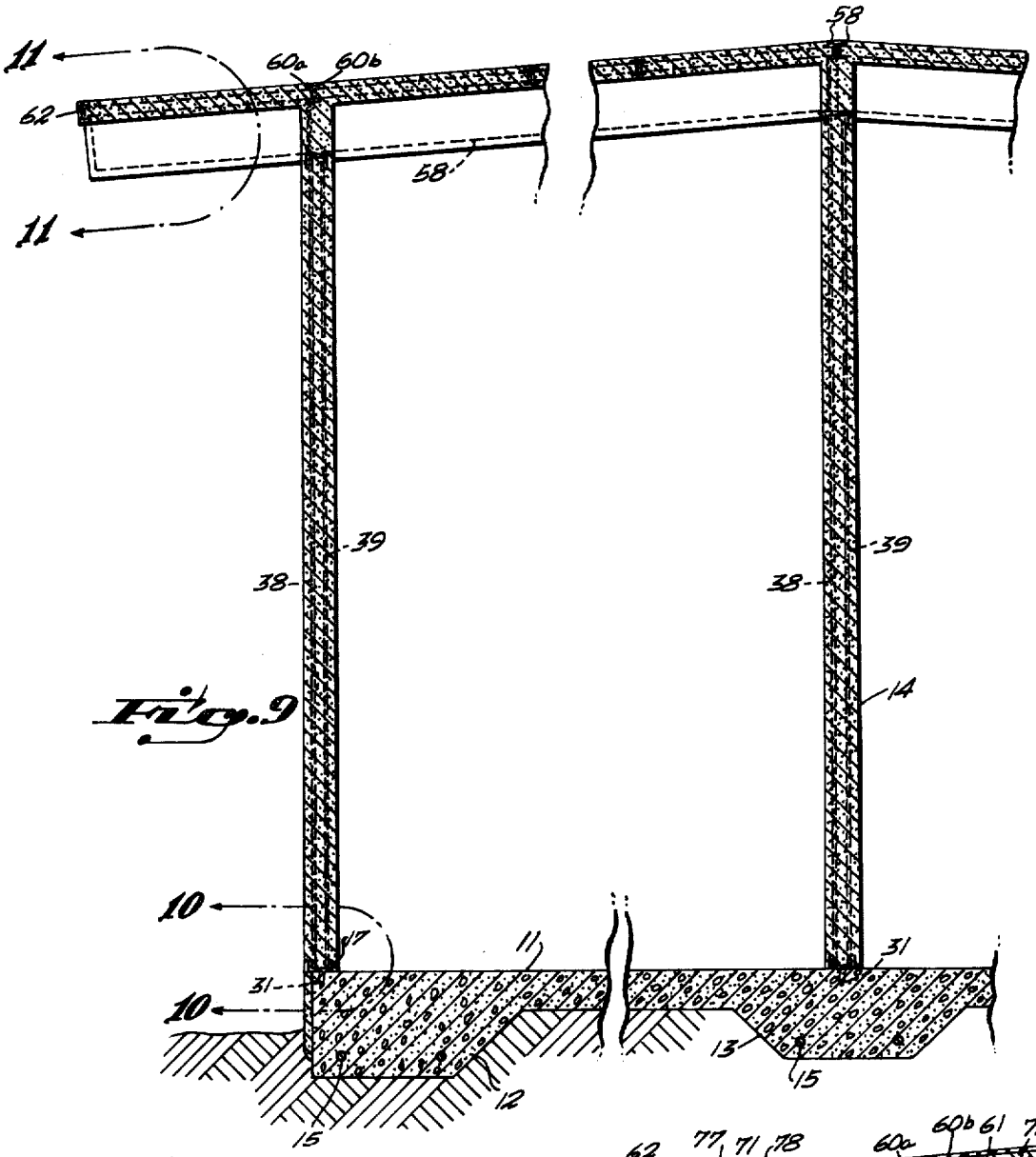
FIG. 9 is a partial transverse vertical section of the finished building, on an enlarged scale.
Figure 10:
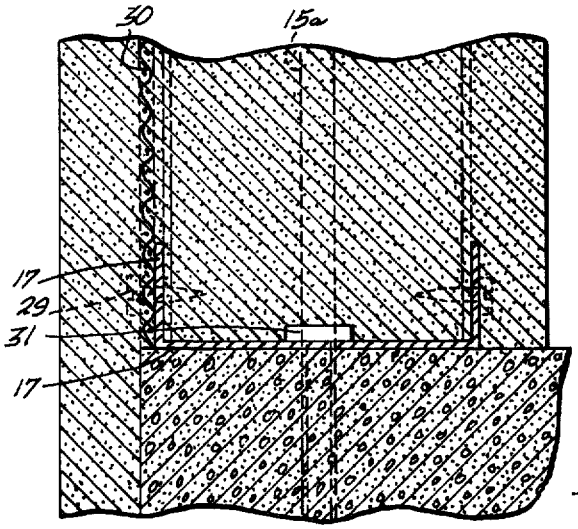
FIG. 10 is an enlarged view of the area indicated at 10—10 of FIG. 9, illustrating constructional details at the juncture of the building with the floor slab.

Assembly of each of the panels comprising the outer and inner walls of the building from their component packages can readily be accomplished with the aid of a wooden template supported on a flat surface, such as the the slab upon which the building is being erected. Referring again to the typical outer wall metal framing panel 16 as being representative of the skeletal building framework, the same comprises channel-shaped sheet metal sole and top plate members 17 and 18, respectively, between which extends channel-shaped sheet metal rib members 19 through 28, the ends of which fit into the opposed recesses of said sole and top plate members and are secured in place as by sheet metal screws 29 by the use of screw guns. Each channel member framework panel will also be faced with expanded sheet metal 30 secured to outside portions of the sole and top plates and the interconnecting ribs of each panel by sheet metal screws **30*a*, for example (see FIG. 3). As illustrated in FIGS. 1 and 3, once an assembled wall panel such as the outer wall panel 16 of FIG. 3 has been completed, it will be located at its footing position in accordance with the floor plan, (see also FIG. 2), whereat it will be secured temporarily by the use of a plurality of concrete nails 31 (see FIGS. 9, 10 and 14) spaced along the inside of the sole plate member 17. Appropriately spaced openings will be provided in the sole plate member 17 for through passage of the perimeter hooked anchor rods 15*a***, (FIGS. 6 and 14), which extend approximately 3 feet vertically upwardly through the center of the exterior and bearing wall panels, to be embedded therein as is hereinbelow more particularly described.

It will be understood that as each wall panel is erected and thus secured in place, bracing, if needed, such as angular 2 × 4 sway support means, will be utilized to maintain vertical positioning until enough of the prefabricated panels are erected to provide for self-support.

Figure 14:
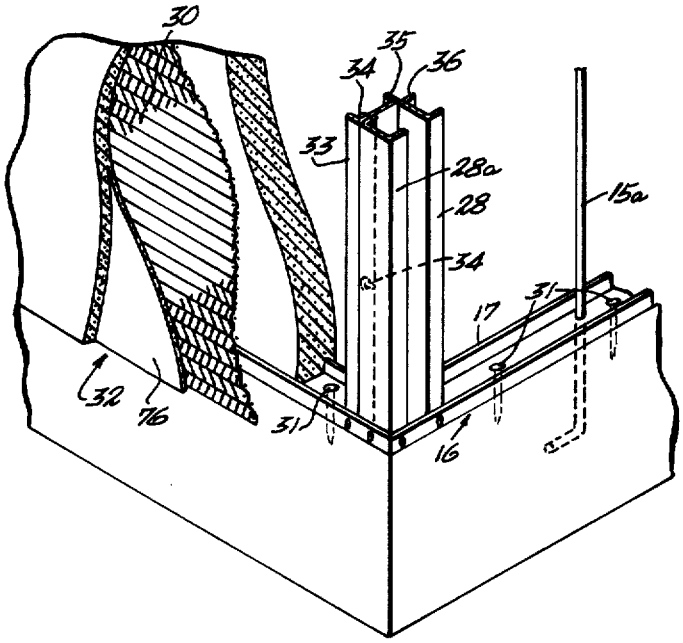
FIG. 14 is a fragmentary outside corner portion of the building, in oblique view, with portions broken away to reveal constructional details.

As illustrated in FIG. 14, wherein two outer wall metal framing panels 16 and 32, for example, meet at an outside corner, two channel-shaped ribs **28, 28*a* will fit against a single rib 33 with the inner web of the outer rib 28*a* secured to the end rib 33 as by sheet metal screws 34 centrally spaced therealong. With such construction, not only are the corners of the building reinforced in strength, but plaster ground surfaces 35, 36** are provided at the inside for screeding the cementacious mixture utilized in further fabrication of a building wall at the site in the manner hereinafter more particularly described.

Figure 4:
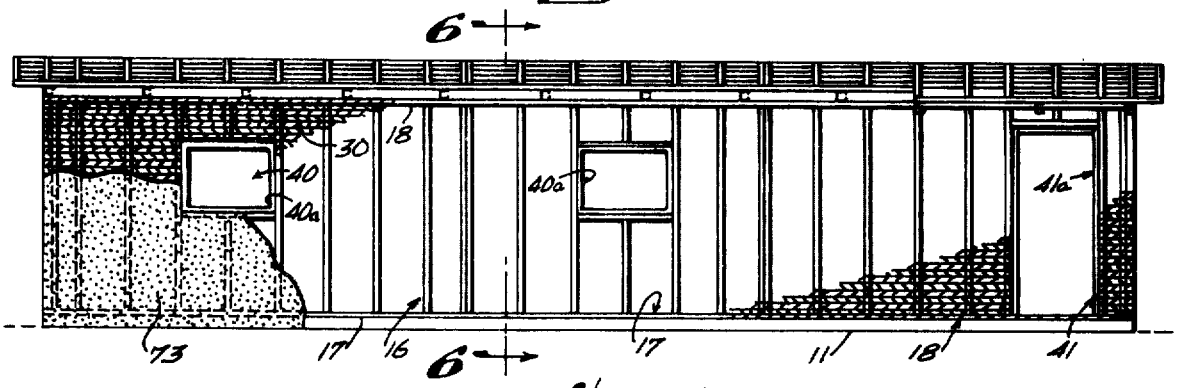
FIG. 4 illustrates completion of the erection and assembly of the prefabricated steel panels, and further illustrates the partial application of the cement plaster scratch coat to the outside of the outer wall panels.
Figure 5:
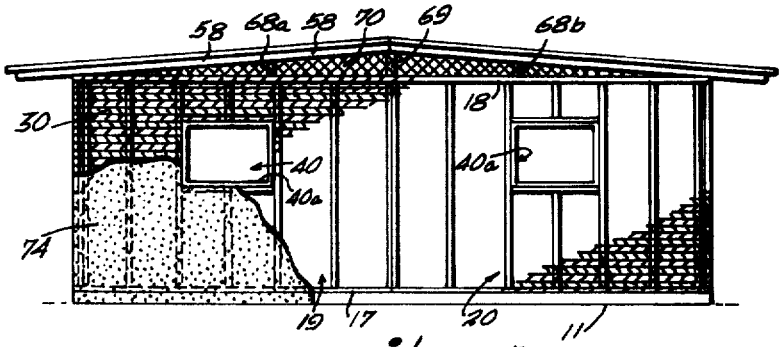
FIG. 5 is an end view of the building showing details of the sidewall and roof panel interconnection.
Figure 12:
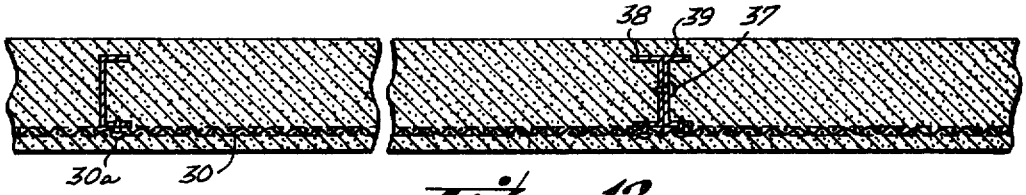
FIG. 12 is a partial horizontal cross-sectional view of a pair of wall panels at their juncture, where more than one panel is required to complete the length of a wall.

As illustrated in FIG. 12, inner abutting metal wall panels, after assembly and erection, will be secured to one another as by sheet metal screws 37 centrally spaced along abutting end ribs 38, 39, for example. As illustrated in FIGS. 3, 4 and 5, each of the outer wall metal component framing panels 16, 17, 18, 19, 20 etc. will be of such width as required by the floor plan of the building for which they are designed, and may include one or more window frame openings 40 and door jamb openings 41 of such size as permits of ready insertion and assembly therein of window frames **40*a* and door subjamb units 41*a***.

Figure 8:
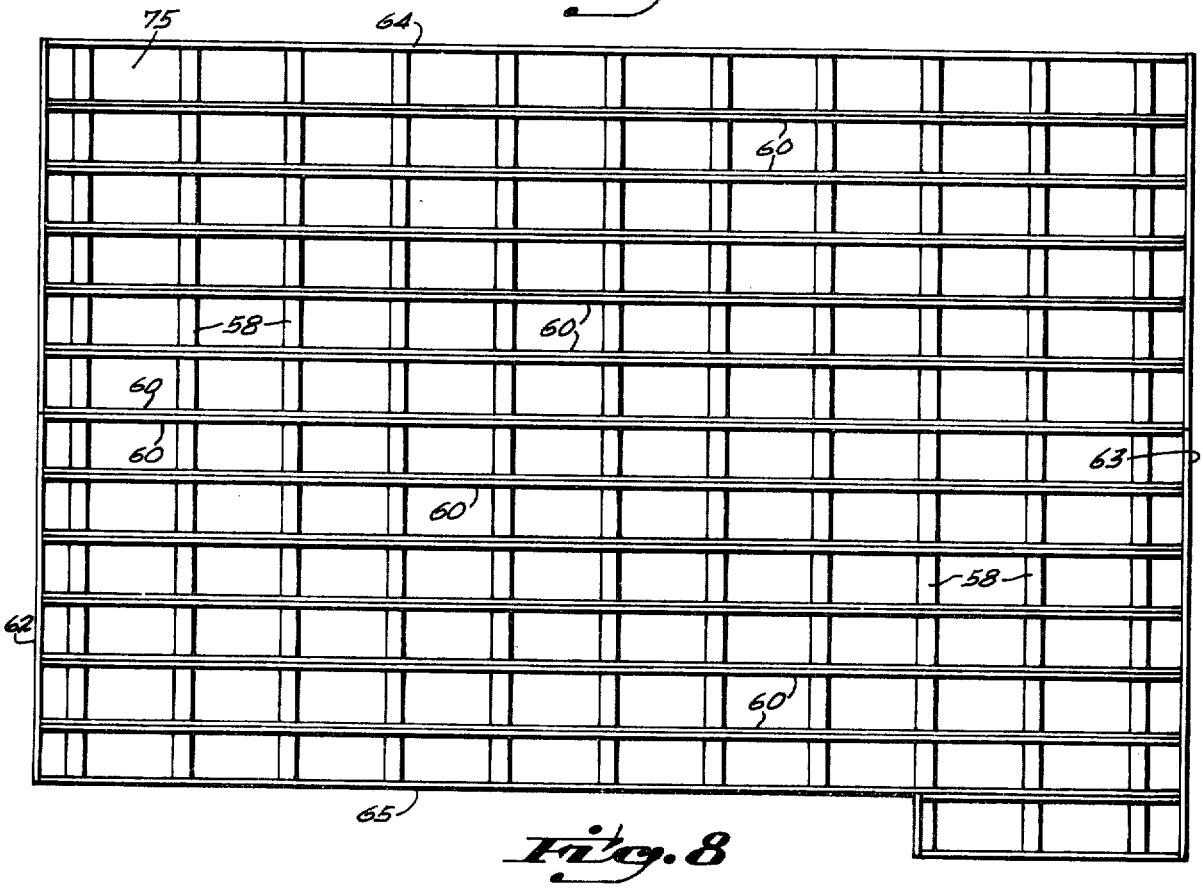
FIG. 8 is a top view of the prefabricated steel roof framework assembly.
Figure 11:
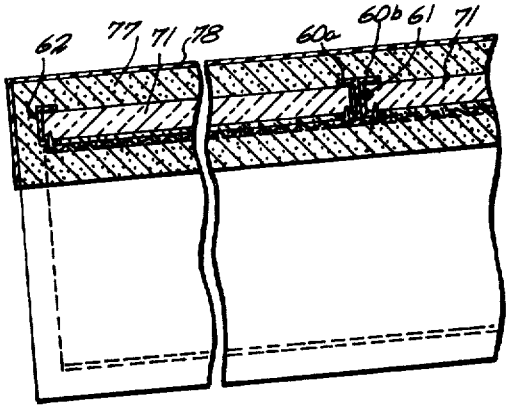
FIG. 11 is an enlarged view of the area indicated at 11—11 of FIG. 9, illustrating construction details of the finished roof at the overhang.
Figure 13:
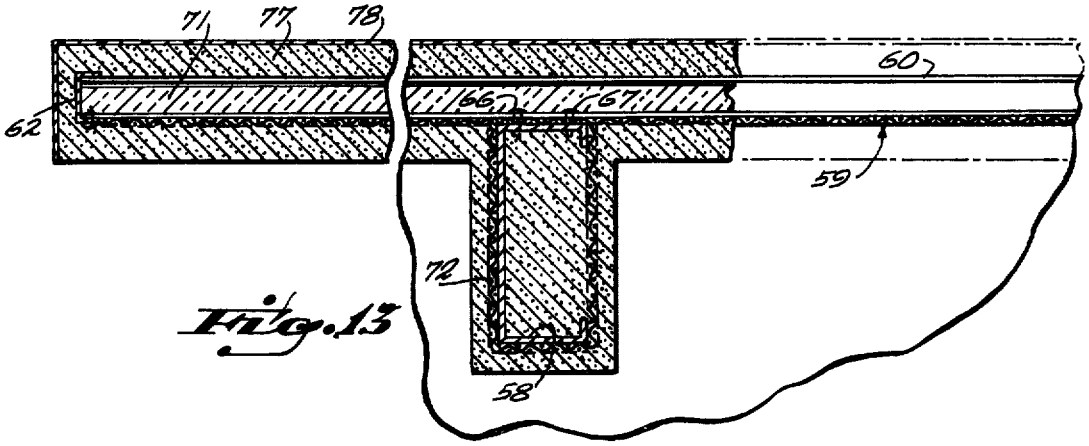
FIG. 13 is a partial vertical cross-sectional view of the finished roof structure, with portions broken away to illustrate details.

As illustrated in FIGS. 2 and 6, interior wall construction dividing the building into various rooms consisting of, for example, bedrooms 42, 43, 44, living room 45, kitchen-dining area 46 and bathroom 47, comprises the central longitudinal bearing wall 14 and room dividing walls 48, 49, 50, 51, 52, 53, 54, 55, 56 and 57. All of the interior walls of the building will be of a construction similar to that of the exterior prefabricated wall panels, hereinabove described, with minor variations as to size, the placement of door jambs, etc. The bathroom wall panel 57 will be of increased width to provide extra space for enclosing plumbing piping, particularly waste and vent plumbing. The interior bearing wall 14, as illustrated FIGS. 5 and 6, is supported above the central longitudinal interior footing 13 and is of increased height to serve as a ridge support for steel channel roof beams 58 (see FIG. 6). The steel channel beams 58 will preferably be spaced along four foot centers and extend any appropriate or desired distance beyond the outer walls at each side of the building for facia and eaves support. The roofing frame-work further comprises longitudinally-extending steel channel rib members 60, (see FIGS. 8 and 11), held together as by self-tapping screws 61. As illustrated in FIGS. 8, 11 and 13, each end of the rib channel members 60 will be spanned by single channel rib members 62, 63. The outer ends of the roof beams 58 similarly will be spanned by [-shaped roof channel beams 64, 65. The rib members 60 will be secured atop the channel beams 58 at crossing points, as by self-tapping screws 66, 67 (see FIG. 13). Expanded sheet metal 59 will be interposed the steel channel roof beams 58 and the rib members 60 comprising the roofing framework.

As illustrated in FIG. 5, the gable ends of the roofing framework are fitted with strut rib members 68*a*, 68*b* and 69 secured in place such as between the upper ends of the outer wall framing panels 19, 20 and the associated vertically-registering channel roof beam 58. As further illustrated in FIG. 5, the triangular area at the gable ends of the structure, between the roofing framework and the top of the outer wall metal framing panels, will be enclosed by securing in place expanded sheet metal 70 by the use of self-tapping screws.

As illustrated in FIGS. 11 and 13, roof insulation is provided for by inserting insulation board 71 between adjacent pairs of roof channel ribs 62, 60*a*, 60*b*, 60*a*, etc.

After the metal component sidewall and roof framing has been completed and assembled as described above, the window frames 40*a* and exterior door sub-frames 41*a* (see FIGS. 4, and 5), and interior door frames, (not detailed in FIG. 12) will be installed, peripheral inner and outer edges of which will serve as grounds for the finishing of the structure with cementacious material, as is hereinbelow more particularly described. The metalwork is completed by surrounding the insides of the steel channel roof beams 58 with expanded sheet metal, as indicated at 72 in FIG. 13. Since, as described above, the metal framework members comprising the exterior and interior walls and the roofing of the building have been cut to size for the most part at the factory, erection on the prepared slab as described above can be accomplished, for a small three bedroom home, within 8 hours or less.

After completion of assembly and erection of the housing framework as described above, the rough plumbing and electrical conduit will be installed within the wall framework wherever appropriate, in the usual manner. Because the finished walls will be filled with cementacious material, as hereinafter more particularly described, flexible plastic tubing can be utilized for electrical wiring conduits. Since such tubing can readily be bent without the use of tools, and because it is inexpensive as compared with rigid electrical conduit or flexible metal-sheathed wiring, there are substantial savings both in labor and in material costs. Moreover, since the finished walls will be of solid construction with a strength and rigidity comparable with that of concrete, it will be understood that there will be substantially no danger of damage to the electrical conduits and wiring encased therein during the life of the building.

As the next step in the completion of the building on the construction site, a scratch-coat of cement plaster will be applied to the outside of all of the expanded sheet-metal work, including all exterior and interior walls and the roofing assembly, as illustrated at 73, 74, 75 and 76, respectively, in FIGS. 4, 5, 8 and 14. After the scratch coating has firmly set, which will ordinarily occur overnight between working days, the framing outer wall portions will be of sufficient rigidity to permit the next step, namely the filling in of the insides of the inner and outer building wall assemblies with a cementacious mixture. Although this can be done by hand, it can be accomplished expeditiously by pumping the cement mixture through a spray-on nozzle with use of a cement pump and mixer. During this operation the insides of the vertical metal ribs and the window or rodding sub-frames and door sub-frames will be used as grounds for screeding the cement mixture thus applied to flat interior surfaces. It has been found that by adding approximately two quarts of drilling clay to each cubic yard of cementacious mixture pumped in place as a suspension agent, not only will sagging of checking of the damp cement thus applied be substantially eliminated, but screeding to a smooth outer surface can be much more easily accomplished in a single, continuous application.

After the exterior and interior wall framing has been filled and screed-finished as described above, the roofing framework will similarly be filled or decked from above, the scratch-coated expanded sheet-metal being at the inside of the building and offering firm support for cementacious mixture from above. In this connection it is to be noted that the roof beams 58 provide such rigidity in the roof framing structure that shoring from underneath will not be required. It is also to be noted that upon the placement of the roof deck cement mixture, indicated at 77 in FIGS. 11 and 13, the insulation boards 71 will become fully imbedded in the cementatious mixture components comprising the finished roof.

Although the use of insulation board 71 is illustrated and described herein as providing for roofing insulation, other insulating materials, such as sprayed-in place urethane foam could also be used as the insulating layer in the roof assembly. Similarly, the inner and outer vertical walls of the building, and particularly the outer walls, could be provided with an interior layer of sprayed-in-place urethane foam or the like before application of the sprayed-in-place cementacious mixture for finishing the open sides of the vertical wall framework as herein above described. Such layers, moreover, would serve as moisture barriers as well as for thermal and acoustic insulation.

With reference again to FIG. 13, the upper surface and facia ends of the poured or pumped in place cementacious mixture will be coated with a suitable roof sealent 78, which can be brushed, troweled or sprayed in place.

After the vertical wall and roofing framework has been enclosed with structural cementacious material as described above, the wall and ceiling surface areas will be plastered to a smooth or textured finish, as desired. In this connection it is to be noted that since the scratch-coat of the exterior wall framework will be at the outside of the building, it will be a simple matter to produce ornamental finish-work, such as imitation brick, wherever desired. During the completion of the cement and plaster work, it is easy to install the window frames and door jambs in their sub-frames. Finally, the plumbing and electrical installation can be completed, as well as can installation of the window sashes, doors and kitchen cabinetry. It will also be understood that, although not illustrated or described herein, duct-work, wiring and piping for a central air conditioning system can be installed within the building framework, if desired.

It is to be particularly noted that in the pumping in place of the cementacious material within the voids between the ribs of the side wall and roofing framework, and in the application of scratch-coats and finish coats to the building walls, there will be a continuity of structural cement bonding the various wall and roofing framework members together in unitary or monolithic structure, including the foundation slab and footings, via the hooked steel rods 15*a*. After developing its full strength (within approximately 28 days), this monolithic box-like structure substantially reinforced by its metal framework, will be of such strength and rigidity as to meet even the most stringent earthquake code requirements. In this connection it is also to be noted that the anchor rods 15*a*, being embedded at closely-spaced intervals within the outer walls of the building and anchored in the concrete building foundation, footings and slab minimize any possibility of lateral shift or shear of the building with respect to its foundation, even under severe earthquake conditions.

Another distinct advantage of buildings constructed according to the invention is that, because of the great resistance to heat of its constructional components, it will be practically indestructible by fire.

Yet another advantage of the method and means of building construction herein described is that it is unusually practicable in its prefabrication concept and therefore particularly well-suited to fulfilling of the needs of good, basic low-cost residential housing in underdeveloped and economically depressed areas of the world, no matter how remote.

While I have illustrated and described only one form of my building construction and the method inherent therein, it is to be understood that buildings of various sizes and shapes could as well be fabricated by the method and means described. The invention, in brief, comprises all the embodiments and modifications of the invention coming within the scope and spirit of the following claims.

What I claim as new and desire to secure by Letters Patent is:

1. A monolithic steel reinforced cementacious material building structure, comprising, in combination, a plurality of outer wall panels, each wall panel comprising a plurality of formed sheet metal ribs of U-shaped cross-section arranged in spaced, parallel relation and defining a predetermined interior wall thickness, a covering of uniformly apertured sheet metal secured directly against one side of each of the ribs of said wall panels, a coating of cementacious material on the outside of said apertured sheet metal covering, a monolithic filling of cementacious material between the ribs of each of said wall panels and extending through to the other side of each of said ribs, said panels being secured in end-to-end abutting relation to define the outer periphery of a building, a plurality of formed metal steel beams spanning and secured to upper end portions of opposite side walls of said building outer periphery and arranged in spaced, parallel relation thereupon, a plurality of spaced, parallel formed sheet metal roofing rib members fixed upon and secured to said roof beams in perpendicularly crossing relation with respect thereto, a covering of uniformly apertured sheet metal secured against the underside of said roofing ribs, a coating of cementacious material on the underside of said apertured sheet metal covering said roofing ribs, a filling of cementacious material between said roofing ribs above said roofing rib apertured sheet metal covering and providing a roof deck, and an outer layer of roof sealant applied to the outside of said roof deck.

2. A building structure as defined in claim 1 wherein said roofing ribs are of channel shape so arranged as to define a plurality of opposed tracks for the sliding reception therebetween of side-by-side panels of insulation material fitted therebetween to provide for roofing insulation.

3. A building structure as defined in claim 1, wherein said roof beams are of bent steel defining a rectangular cross-sectional configuration, the outer periphery of said beams and the interior side of said cementacious material coated roofing apertured sheet metal being plastered with a uniform monolithic finish coat of cementacious material.

4. A building structure as defined in claim 3, wherein each of said wall panels is provided with a horizontally extending formed sheet metal top plate interconnecting the upper ends of said wall panel sheet metal ribs, and a formed sheet metal sole plate interconnecting the lower ends of said wall panel sheet metal ribs, a reinforced concrete floor slab, means securing the sole plates of said wall panels to said floor slab.

5. A building structure as defined in claim 4, wherein said means for securing said sole plates of said wall panels to said reinforced floor slab comprises a plurality of steel reinforcing rods anchored in said floor slab and extending upwardly through said sole plates into zones between said wall panel rib members to be embedded in said filling of cementacious material between the ribs of each of said wall panels.

6. A building structure as defined in claim 5, wherein said building structure is rectangular in configuration and includes a plurality of interior wall panels extending end-to-end along a central position within the structure and having a height somewhat greater than the height of said peripheral wall panels, said steel beams extending between the upper end of said interior wall panels downwardly to each side to said upper end portions of said opposite side walls of said building to provide for gable construction, the gable ends thereby defined each being completed by a plurality of vertical strut members, uniformly apertured sheet metal secured against the outsides of said strut members, and cementacious material applied to the outside and inside of said strut members.

7. A building structure as defined in claim 6, wherein said coverings of uniformly apertured sheet metal consist of expanded sheet metal.

8. A building structure as defined in claim 7, wherein said interior wall panels are of the same construction as said above-described outer wall panels, and a plurality of steel reinforcing rods anchored in said floor slab and extending through the sole plates of said interior wall panels into zones between said interior wall rib members to be embedded in the filling of cementacious material between the ribs of each of said interior wall panels.

9. A building structure as defined in claim 8, including a plurality of window openings and at least one door opening in said peripheral outer wall panels.

10. A building structure as defined in claim 9, including a plurality of additional interior wall panels, each of said interior wall panels comprising a plurality of formed sheet metal ribs arranged in spaced, parallel relation and defining a predetermined interior wall thickness, a covering of expanded sheet metal secured against one side of each of said interior wall panels, a coating of cementacious material on the outside of said expanded sheet metal covering, a filling of cementacious material between the ribs of each of said interior wall panels and extending to the other side of each of said panels, said panels being so vertically arranged, spaced, and interconnected to one another and to interior portions of said outer wall paneling and to said first plurality of interior wall panels as to define the various internal rooms and areas of the building construction.

* * * * *